US012484726B2

(12) United States Patent
Surgent

(10) Patent No.: US 12,484,726 B2
(45) Date of Patent: Dec. 2, 2025

(54) SYSTEM AND METHOD FOR MAKING AN ICE STRAW

(71) Applicant: Prive Products, LLC, Dallas, TX (US)

(72) Inventor: Thomas Surgent, Dallas, TX (US)

(73) Assignee: Prive Products, LLC, Dallas, TX (US)

( * ) Notice: Subject to any disclaimer, the term of this patent is extended or adjusted under 35 U.S.C. 154(b) by 426 days.

(21) Appl. No.: 17/609,970

(22) PCT Filed: May 16, 2020

(86) PCT No.: PCT/US2020/033309
§ 371 (c)(1),
(2) Date: Nov. 9, 2021

(87) PCT Pub. No.: WO2020/232423
PCT Pub. Date: Nov. 19, 2020

(65) Prior Publication Data

US 2022/0218135 A1 Jul. 14, 2022

Related U.S. Application Data

(60) Provisional application No. 62/848,963, filed on May 16, 2019.

(51) Int. Cl.
*A47G 21/18* (2006.01)

(52) U.S. Cl.
CPC ..... *A47G 21/18* (2013.01); *A47G 2400/10* (2013.01)

(58) Field of Classification Search
CPC .... F25C 1/142; F25C 1/24; F25C 1/08; F25C 1/045; A47G 21/18
See application file for complete search history.

(56) References Cited

U.S. PATENT DOCUMENTS 424,005 A * 3/1890 Kitton ..... F25C 1/24 62/356
2,285,149 A 6/1942 D'Arcey
(Continued)

FOREIGN PATENT DOCUMENTS

BE 1007705 A6 10/1995
CN 2526760 Y * 12/2002
(Continued)

OTHER PUBLICATIONS

KR-20070000163-U Translation (Year: 2007).*
(Continued)

*Primary Examiner* — David J Teitelbaum
(74) *Attorney, Agent, or Firm* — Barnes & Thornburg LLP; Jerry C. Harris, Jr.

(57) ABSTRACT

A system and method for making degradable drinking straws made of ice (or other frozen liquid(s)). The system may comprise one or more tubes configured to extend into a reservoir. The tubes may each be in fluid communication with a connecting bar, wherein fluid (e.g., a liquid and/or a gas) within the connecting bar may be directed into the tubes. The system may comprise a source of cold fluid and a source of hot fluid in fluid communication with the connecting bar. The degradable straw may comprise a wall (or thickness) made of ice with a hollow, cavity, and/or void space through the straw. The degradable straw may serve to cool the drink (as any other piece of ice within the drinking liquid) via placement in a drink and/or via the drink passing through the void space into a user's mouth.

10 Claims, 9 Drawing Sheets

(56) References Cited

U.S. PATENT DOCUMENTS

| | | | | | |
|---|---|---|---|---|---|
| 6,056,206 | A * | 5/2000 | Whiton | A47G 21/181 | 239/33 |
| 2005/0109857 | A1 * | 5/2005 | Boone, Jr. | A47G 21/18 | 239/16 |
| 2009/0162492 | A1 * | 6/2009 | Conway, Jr. | A23G 3/545 | 426/390 |

FOREIGN PATENT DOCUMENTS

| | | | | |
|---|---|---|---|---|
| CN | 201452638 | U | 5/2010 | |
| DE | 102007038005 | A1 | 2/2009 | |
| KR | 1020000017791 | A | 4/2000 | |
| KR | 20070000163 | U * | 2/2007 | A47G 21/187 |
| KR | 2020070000163 | U | 2/2007 | |
| KR | 20080061179 | A * | 7/2008 | F25C 5/182 |
| KR | 1020090066099 | A | 6/2009 | |
| KR | 2020140003984 | U | 6/2014 | |
| WO | WO-9011480 | A2 * | 10/1990 | |
| WO | 2009078562 | A1 | 6/2009 | |
| WO | 2017120673 | A1 | 7/2017 | |

OTHER PUBLICATIONS

KR-20080061179-A Translation (Year: 2008).*
CN-2526760-Y Translation (Year: 2002).*
WO-9011480-A2 Translation (Year: 1990).*
European Patent Office, Extended European Search Report issued in related European Patent Application No. 20806770.2, Jun. 3, 2022, 8 pages.
Korean Patent Office, International Search Report issued in PCT/US2020/033309, Sep. 11, 2020, 4 pages.
Korean Patent Office, Written Opinion issued in PCT/US2020/033309, Sep. 11, 2020, 8 pages.

* cited by examiner

SYSTEM AND METHOD FOR MAKING AN ICE STRAW

CROSS-REFERENCE TO RELATED APPLICATIONS

The present application is a U.S. nationalization 35 U.S.C. § 371 of International Application No. PCT/US2020/033309, filed May 16, 2020, which claims priority to U.S. Provisional Application Ser. No. 62/848,963, filed on May 16, 2019 and entitled "System and Method for Making an Ice Straw.". The disclosures set forth in the referenced applications are incorporated by reference herein in their entireties

STATEMENT REGARDING FEDERALLY SPONSORED RESEARCH OR DEVELOPMENT

Not applicable.

REFERENCE TO A MICROFICHE APPENDIX

Not applicable.

BACKGROUND

Studies have shown that, in the United States alone, over five hundred million drinking straws are used in a single day. Moreover, other studies have shown that over eight billion plastic drinking straws currently pollute the world's beaches.

Some studies have suggested that plastic drinking straws be replaced with paper drinking straws. However, such a replacement merely substitutes one environmentally adverse, single use item with another environmentally adverse, single use item. For example, the environmental impact of paper drinking straws includes cutting down trees, pulping and pressing the derived tree product into a tube, then using fossil fuels to ship the paper drinking straws to users across the country. What is needed is a more environmentally friendly device, and method of making such a device, which can help reduce the levels of plastic pollution around the world, as well as reduce the need to utilize non-renewable resources, for allowing users to enjoy drinking (and cooling) their beverages.

TECHNICAL FIELD

Various embodiments relate generally to forming a degradable drinking straw from renewable resources, e.g., water, wherein the renewable resource is cooled to, or below, its freezing point while comprising a fluid conduit which allows for the passage, and cooling, of a fluid from one end of the degradable drinking straw to its other end.

SUMMARY

In some embodiments is described a method of making a degradable drinking straw, comprising: positioning a tube within a reservoir, wherein the reservoir is configured to hold a liquid to be frozen; contacting the lube with a base plate, wherein the tube is at least partially inserted into the base plate, and wherein the base plate forms a base of the reservoir, filling the reservoir with liquid; filling the tube with a first fluid at a temperature at or below the freezing point of the liquid, causing at least a portion of the liquid in the reservoir to freeze around the tube, forming the degradable drinking straw; maintaining the fluid in the tube for an amount of time to form a desired thickness of the degradable drinking straw; and filling the tube with a second fluid at a temperature at or above the melting point of the degradable drinking straw, causing the degradable drinking straw to partially melt at the contact points with the surface of the tube, allowing the degradable drinking straw to be released from contact with the tube.

In some embodiments is described a method of making a plurality of degradable drinking straws, comprising: positioning a plurality of tubes within a reservoir, wherein the reservoir is configured to hold a liquid to be frozen; contacting the plurality of tubes with a base plate, wherein the plurality of tubes is at least partially inserted into the base plate, and wherein the base plate forms a base of the reservoir; filling the reservoir with liquid; filling the plurality of tubes with a first fluid at a temperature at or below the freezing point of the liquid, causing at least a portion of the liquid in the reservoir to freeze around the plurality of tubes, forming the plurality of degradable drinking straws; maintaining the fluid in the plurality of tubes for an amount of time to form a desired thickness of each of the plurality of degradable drinking straws; and filling the plurality of tubes with a second fluid at a temperature at or above the melting point of the plurality of degradable drinking straws, causing the plurality of degradable drinking straws to partially melt at the contact points with the surfaces of the plurality of lubes, allowing the plurality of degradable drinking straws to be released from contact with the plurality of tubes.

In some embodiments is described a system for making one or more degradable drinking straws, the system comprising: a base plate configured to form one side of a reservoir for holding a liquid to be frozen into the one or more degradable drinking straws; one or more tubes configured to contact the base plate and positioned within the reservoir; at least one connecting bar in fluid communication with the interior of the one or more tubes; at least one source of a first fluid, the first fluid at a temperature at or below the freezing point of the liquid to be frozen into the one or more degradable drinking straws, in fluid communication with the at least one connecting bar configured to feed the first fluid into the at least one connecting bar and therefore into the one or more tubes; and at least one source of a second fluid, at a temperature at or above the melting point of the one or more degradable drinking straws, in fluid communication with the at least one connecting bar configured to feed the second fluid into the at least one connecting bar and therefore into the one or more tubes.

In some embodiments is described a mold for forming a degradable drinking straw comprising: a base portion, wherein the base portion comprises at least two tube engagement structures; a top portion, wherein the top portion comprises at least one opening configured for fluid communication, a tube engagement structure, and a tube opening; a first tube, wherein the first tube is configured to engage a first engagement structure of the base portion and also engage the top portion; and a second tube, wherein the second tube is configured to engage a second engagement structure of the base portion, pass through the tube opening of the top portion, and substantially reside within the interior of the first tube.

In some embodiments is described a method of forming a degradable drinking straw comprising: introducing a liquid into a mold; subjecting the mold and its contained liquid to a temperature at or below the freezing point of the liquid; maintaining the mold and its contained liquid at the temperature at or below the freezing point of the liquid until the liquid within the mold has frozen and formed a frozen structure comprising an outer surface which defines an inner void, wherein the inner void is configured to provide a fluid conduit which spans at least a portion of the length of the frozen structure; subjecting the mold and its contained frozen structure to a temperature at or above the melting point of the frozen structure; maintaining the mold and its contained structure at the temperature at or above the melting point of the frozen structure until the frozen structure can be removed from the mold as the degradable drinking straw; and removing the frozen structure from the mold.

In some embodiments is described a degradable drinking straw comprising: a frozen liquid, wherein the frozen liquid forms a wall which comprises an inner void, wherein the inner void provides a fluid conduit which passes through the frozen liquid.

BRIEF DESCRIPTION OF THE DRAWINGS

For a more complete understanding of the present disclosure, reference is now made to the following brief description, taken in connection with the accompanying drawings and detailed description, wherein like reference numerals represent like parts.

DETAILED DESCRIPTION

It should be understood at the outset that although illustrative implementations of one or more embodiments are illustrated below, the disclosed systems and methods may be implemented using any number of techniques, whether currently known or not yet in existence. The disclosure should in no way be limited to the illustrative implementations, drawings, and techniques illustrated below, but may be modified within the scope of the appended claims along with their full scope of equivalents.

The following brief definition of terms shall apply throughout the application:

The term "comprising" means including but not limited to, and should be interpreted in the manner it is typically used in the patent context;

The phrases "in one embodiment," "according to one embodiment," and the like generally mean that the particular feature, structure, or characteristic following the phrase may be included in at least one embodiment of the present invention, and may be included in more than one embodiment of the present invention (importantly, such phrases do not necessarily refer to the same embodiment);

If the .specification describes something as "exemplary" or an "example," it should be understood that refers to a non-exclusive example;

The terms "about" or "approximately" or the like, when used with a number, may mean that specific number, or alternatively, a range in proximity to the specific number, as understood by persons of skill in the art field (for example, ±10%); and If the specification stales a component or feature "may," "can," "could," "should," "would," "preferably," "possibly," "typically," "optionally," "for example," "often," or "might" (or other such language) be included or have a characteristic, that particular component or feature is not required to be included or to have the characteristic. Such component or feature may be optionally included in some embodiments, or it may be excluded.

Embodiments of the disclosure include drinking straws made of ice (or other frozen liquid), and systems and methods for making drinking straws made of ice (or other frozen liquid), i.e. degradable drinking straws. Embodiments of the disclosure describe a degradable drinking straw, and methods and systems for making a degradable drinking straw.

Figure 1A:
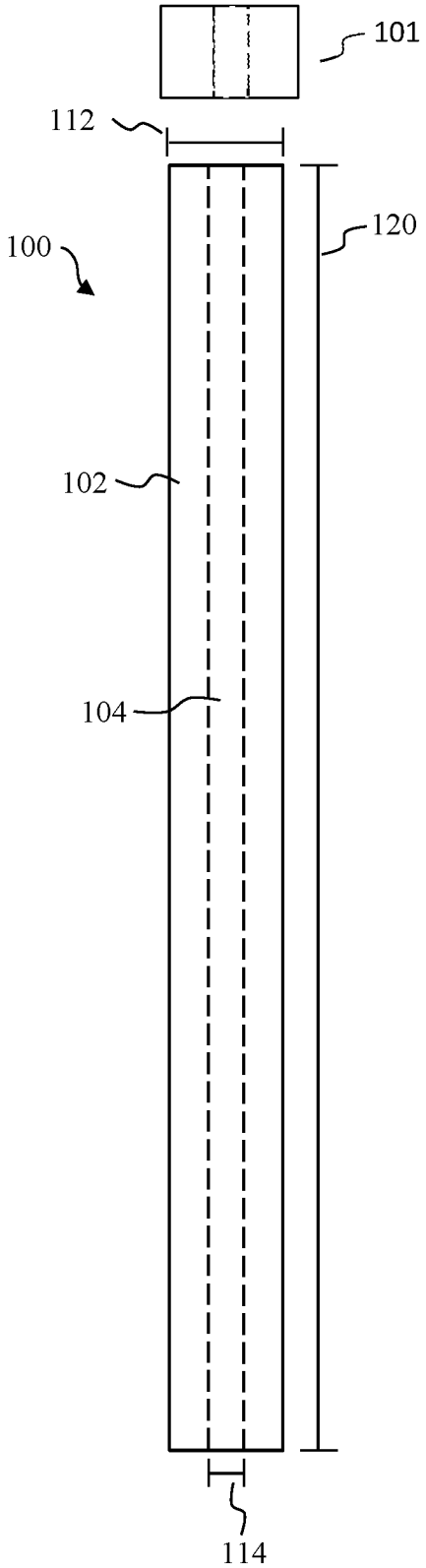
FIGS. 1A-1B illustrate a cylindrical degradable drinking straw according to an embodiment of the disclosure.
Figure 1B:
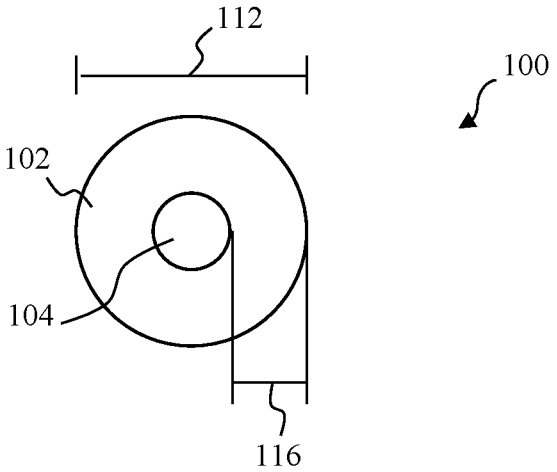

Referring now to FIGS. 1A-1B, a straw 100 is shown, wherein the straw 100 may comprise a wall (or thickness) 102 made of ice (or other frozen substance/frozen liquid) with a hollow, cavity, and/or void space 104 through the straw 100 which serves as a fluid conduit for a user's drink. The straw 100 may be used in a drink and may be positioned partially in a drinking liquid and partially extending from the drinking liquid toward the user. The straw 100 may serve to cool the drink (as any other piece of ice within the drinking liquid) while also providing a degradable drinking straw. The straw 100 may be configured to allow a user to drink the drinking liquid via the straw 100 and may be configured to eventually melt and degrade over time.

The ice straw 100, also referred to a degradable drinking straw, shown in FIG. 1 may comprise an approximately cylindrical shape, and the wall 102 may comprise an outer diameter 112 and an inner diameter 114, wherein the inner diameter 114 may define the hollow 104. In other words, the wall 102 may comprise a diameter 112 and the hollow 104 may comprise a diameter 114. The straw 100 may comprise a length 120. In some embodiments, the wall 102 may comprise a thickness 116, wherein the thickness 116 may be defined by the difference between the outer diameter 112 and the inner diameter 114. In the embodiment shown in FIGS. 1A-1B, the outer diameter 112, the inner diameter 114, and the thickness 116 may be constant along the length 120 of the straw 100.

As an example, the length 120 of the straw 100 may be between approximately 3 and 10 inches. In some embodiments, the length 120 of the straw 100 may be between approximately 4 and 6 inches. In some embodiments, the length 120 of the straw 100 may be approximately 5 inches. In some embodiments, the length 120 of the straw 100 may be approximately 5.5 inches. In some embodiments, the length 120 of the straw 100 may be approximately 5.75 inches. In some embodiments, the length 120 of the straw 100 may be between approximately 7 and 8 inches. In some embodiments, the length 120 of the straw 100 may be approximately 8.5 inches. In some embodiments, the length 120 of the straw 100 may be approximately 8.75 inches. In some embodiments, the length 120 of the straw 100 may be approximately 7.75 inches. As an example, the outer diameter 112 of the straw 100 may be between approximately 0.5 and 1.5 inches. In some embodiments, the outer diameter 112 of the straw 100 may be approximately 0.75 inches. In some embodiments, the outer diameter 112 of the straw 100 may be approximately 0.875 inches. In some embodiments, the outer diameter 112 of the straw 100 may be approximately 1.00 inch. As an example, the inner diameter 114 of the straw 100 may be between approximately 0.1 and 0.5 inches. In some embodiments, the inner diameter 114 of the straw 100 may be approximately 0.25 inches.

In some embodiments, to provide comfort to a user of the straw 100, a cap or sleeve 101 may be configured to fit over the top end (the end of the straw extended toward the user from the drink), wherein the user's mouth may contact the cap instead of contacting the straw directly. The cap or sleeve may comprise paper, plastic, wax, or another suitable material. In some embodiments, a drink lid may be configured to receive and hold a straw (as described herein), wherein the lid may comprise a perforation sufficient in size to insert the straw.

Figure 2A:
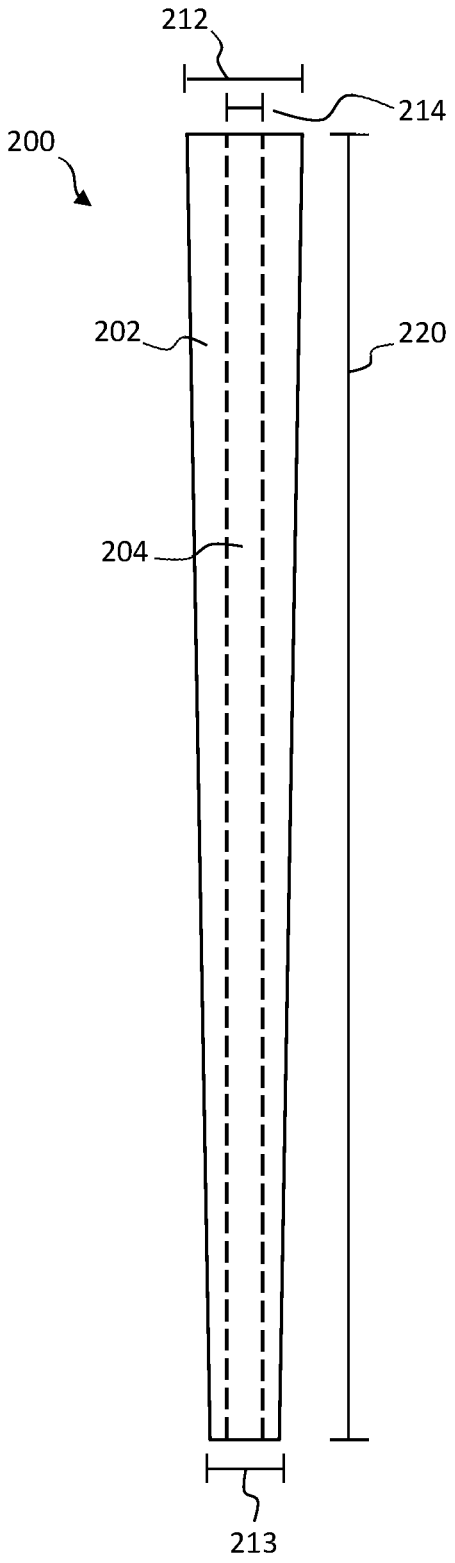
FIGS. 2A-2C illustrate a conical or tapered degradable drinking straw according to an embodiment of the disclosure.
Figure 2B:
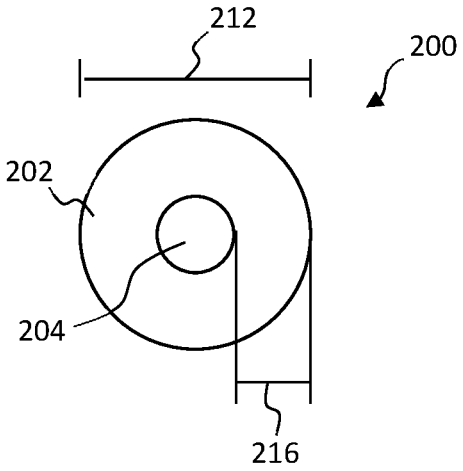
Figure 2C:
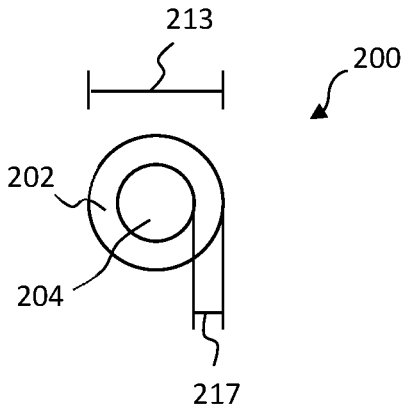

Referring to FIGS. 2A-2C, a straw 200 is shown, wherein the straw 200 may comprise a wall (or thickness) 202 made of ice with a hollow, cavity, and/or void space 204 through the straw 200. The ice straw 200 may comprise an approximately conical shape, and the wall 202 may comprise an outer diameter 212 and an inner diameter 214, wherein the inner diameter 214 may define the hollow 204. In other words, the wall 202 may comprise a diameter 212 and the hollow 204 may comprise a diameter 214. The straw 200 may comprise a length 220. In some embodiments, the wall 202 may comprise a thickness 216, wherein the thickness 216 may be defined by the difference between the outer diameter 212 and the inner diameter 214.

In the embodiment shown in FIGS. 2A-2C, the inner diameter 214 may be constant along the length 220 of the straw 200, while the outer diameter 212 and therefore the thickness 216 may taper along the length 220 of the straw 200 to a second outer diameter 213 and a second thickness 217.

As shown in FIGS. 2A-2C, the outer diameter 212 of the straw 200 tapers from the top to the bottom to the second outer diameter 213, but in formation and/or use, the straw 200 may be turned in any direction. The taper of the straw 200 may facilitate drinking from the straw 200. In some embodiments, the end of the straw with the wider thickness 216 may be inserted into the drink, and the wider thickness may take longer to melt in the drink, while the user may drink from the end with the narrower thickness 217. Alternatively, the end of the straw with the narrower thickness 217 may be inserted into the drink while the user may drink from the end with the wider thickness 216, and as the straw 200 melts in the drink, the straw 200 may slowly sink into the drink (or glass) instead of breaking or falling out of the drink.

In some embodiments, the straw 200 may be formed using a mold, and a tapered outer diameter 212 and 213 may allow gravity to assist with the release of the frozen straw 200 from the mold. In this case, the straw 200 may be formed turned in a vertical direction opposite of that shown in FIG. 2A, wherein the taper may allow the straw to fall (or be released) vertically from a mold.

As an example, the length 220 of the straw 200 may be between approximately 5 and 10 inches. In some embodiments, the length 220 of the straw 200 may be between approximately 7 and 8 inches. In some embodiments, the length 220 of the straw 200 may be approximately 5.5 inches. In some embodiments, the length 220 of the straw 200 may be approximately 5.75 inches. In some embodiments, the length 220 of the straw 200 may be approximately 7.75 inches. In some embodiments, the length 220 of the straw 200 may be approximately 8.5 inches. In some embodiments, the length 220 of the straw 200 may be approximately 8.75 inches. As an example, the outer diameter 212 of the straw 200 may be between approximately 0.5 and 1.5 inches. In some embodiments, the outer diameter 212 of the straw 200 may be approximately 0.75 inches. As an example, the second outer diameter 213 may be less than the outer diameter 212, e.g., the straw 200 is tapered. As an example, the inner diameter 214 of the straw 200 may be between approximately 0.1 and 0.5 inches. In some embodiments, the inner diameter 214 of the straw 200 may be approximately 0.25 inches.

Figure 3A:
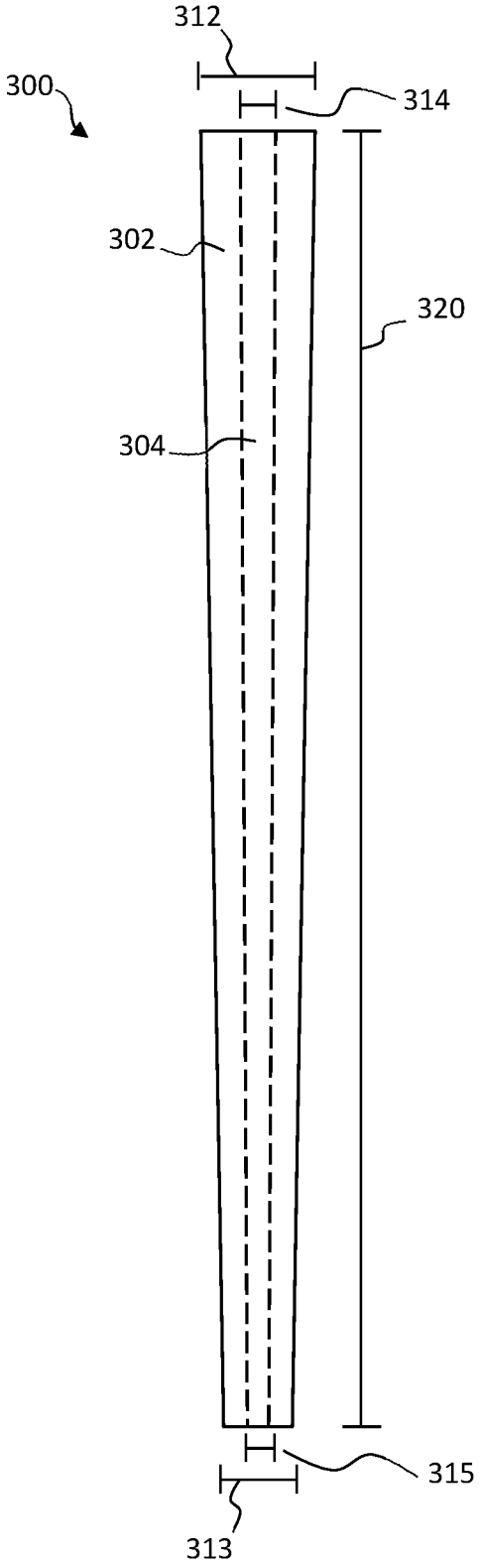
FIGS. 3A-3C illustrate another conical or tapered degradable drinking straw according to an embodiment of the disclosure.
Figure 3B:
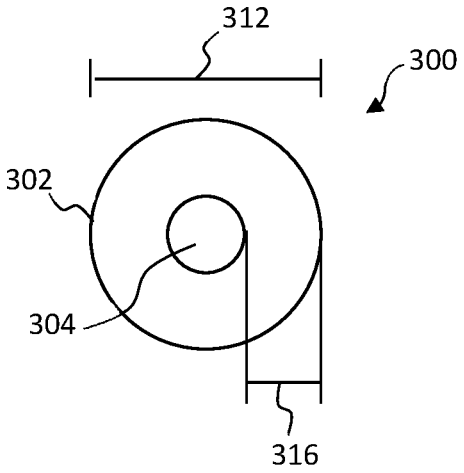
Figure 3C:
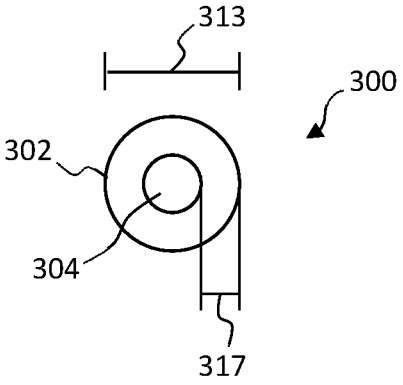

Referring to FIGS. 3A-3C, a straw 300 is shown, wherein the straw 300 may comprise a wall (or thickness) 302 made of ice with a hollow, cavity, and/or void space 304 through the straw 300. The ice straw 300 may comprise an approximately conical shape, and the wall 302 may comprise an outer diameter 312 and an inner diameter 314, wherein the inner diameter 314 may define a portion of the hollow 304. In other words, the wall 302 may comprise a diameter 312 and a portion of the hollow 304 may comprise a diameter 314. The straw 300 may comprise a length 320. In some embodiments, the wall 302 may comprise a thickness 316, wherein the thickness 316 may be defined by the difference between the outer diameter 312 and the inner diameter 314.

In the embodiment shown in FIGS. 3A-3C, the outer diameter 312, the inner diameter 314, and therefore the thickness 316 may taper along the length 320 of the straw 300 to a second outer diameter 313, a second inner diameter 315, and a second thickness 317.

As shown in FIG. 3, the outer diameter 312 and the inner diameter 314 of the straw 300 taper from the top to the bottom to the second outer diameter 313 and the second inner diameter 315, but in formation and/or use, the straw 300 may be turned in any direction. The taper of the straw 300 may facilitate drinking from the straw 300. In some embodiments, the end of the straw with the wider thickness 316 may be inserted into the drink, and the wider thickness may take longer to melt in the drink, while the user may drink from the end with the narrower thickness 317. Alternatively, the end of the straw with the narrower thickness 317 may be inserted into the drink while the user may drink from the end with the wider thickness 316, and as the straw 300 melts in the drink, the straw 300 may slowly sink into the drink (or glass) instead of breaking or falling out of the drink.

In some embodiments, the straw 300 may be formed using a mold, and a tapered outer diameter 312 and 313 may allow gravity to assist with the release of the frozen straw 300 from the mold. In this case, the straw 300 may be formed turned in a vertical direction opposite of that shown in FIG. 3A, wherein the taper may allow the straw to fall (or be released) vertically from a mold.

As an example, the length 320 of the straw 300 may be between approximately 5 and 10 inches. In some embodiments, the length 320 of the straw 300 may be between approximately 7 and 8 inches. In some embodiments, the length 320 of the straw 300 may be approximately 5.5 inches. In some embodiments, the length 320 of the straw 300 may be approximately 5.75 inches. In some embodiments, the length 320 of the straw 300 may be approximately 7.75 inches. In some embodiments, the length 320 of the straw 300 may be approximately 8.5 inches. In some embodiments, the length 320 of the straw 300 may be approximately 8.75 inches. As an example, the outer diameter 312 of the straw may be between approximately 0.5 and 1.5 inches. In some embodiments, the outer diameter 312 of the straw may be approximately 0.75 inches. As an example, the second outer diameter 313 may be less than the outer diameter 312. As an example, the inner diameter 314 of the straw may be between approximately 0.1 and 0.5 inches. In some embodiments, the inner diameter 314 of the straw may be approximately 0.25 inches. As an example, the second inner diameter 315 may be less than the inner diameter 314.

Figure 4A:
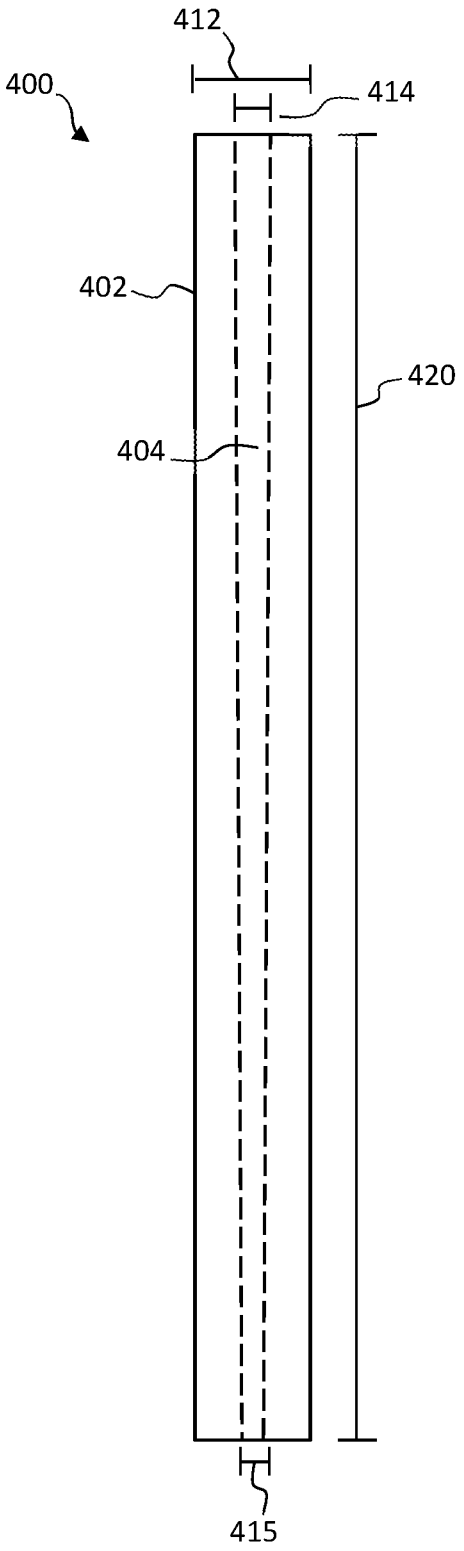
FIGS. 4A-4C illustrate another cylindrical degradable drinking straw with a conical or tapered interior hollow according to an embodiment of the disclosure.
Figure 4B:
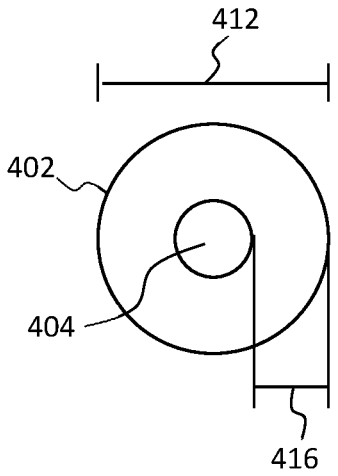
Figure 4C:
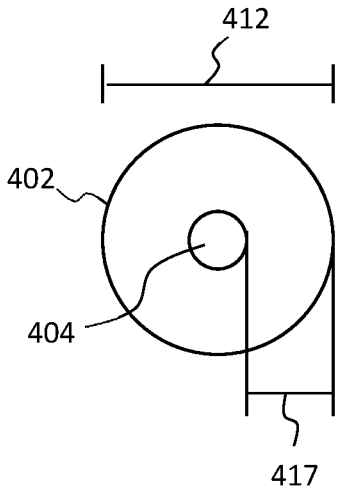

Referring to FIGS. 4A-4C, a straw 400 is shown, wherein the straw 400 may comprise a wall (or thickness) 402 made of ice with a hollow, cavity, and/or void space 404 through the straw 400. The ice straw 400 may comprise an approximately cylindrical shape, and the wall 402 may comprise an outer diameter 412 and an inner diameter 414, wherein the inner diameter 414 may define a portion of the hollow 404. In other words, the wall 402 may comprise a diameter 412 and a portion of the hollow 404 may comprise a diameter 414. The straw 400 may comprise a length 420. In some embodiments, the wall 402 may comprise a thickness 416, wherein the thickness 416 may be defined by the difference between the outer diameter 412 and the inner diameter 414.

In the embodiment shown in FIGS. 4A-4C, the outer diameter 412 may be constant along the length 420 of the straw 400, while the inner diameter 414 and therefore the thickness 416 may taper along the length 420 of the straw 400 to a second inner diameter 415 and a second thickness 417.

As shown in FIG. 4, the inner diameter 414 of the straw 400 tapers from the top to the bottom to the second outer diameter 413, but in formation and/or use, the straw 400 may be turned in any direction. The taper of the straw 400 may facilitate drinking from the straw 400. In some embodiments, the end of the straw with the wider second thickness 417 may be inserted into the drink, and the wider thickness may take longer to melt in the drink, while the user may drink from the end with the narrower thickness 416. Alternatively, the end of the straw with the narrower thickness 416 may be inserted into the drink while the user may drink from the end with the wider thickness 417, and as the straw 400 melts in the drink, the straw 400 may slowly sink into the drink (or glass) instead of breaking or falling out of the drink.

As an example, the length 420 of the straw 400 may be between approximately 5 and 10 inches. In some embodiments, the length 420 of the straw 400 may be between approximately 7 and 8 inches. In some embodiments, the length 420 of the straw 400 may be approximately 5.5 inches. In some embodiments, the length 420 of the straw 400 may be approximately 5.75 inches. In some embodiments, the length 420 of the straw 400 may be approximately 7.75 inches. In some embodiments, the length 420 of the straw 400 may be approximately 8.5 inches. In some embodiments, the length 420 of the straw 400 may be approximately 8.75 inches. As an example, the outer diameter 412 of the straw 400 may be between approximately 0.5 and 1.5 inches. In some embodiments, the outer diameter 412 of the straw 400 may be approximately 0.75 inches. In some embodiments, the outer diameter 412 of the straw 400 may be approximately 0.875 inches. In some embodiments, the outer diameter 412 of the straw 400 may be approximately 1.00 inch. As an example, the inner diameter 414 of the straw may be between approximately 0.1 and 0.5 inches. In some embodiments, the inner diameter 414 of the straw may be approximately 0.25 inches. As an example, the second inner diameter 415 may be less than the inner diameter 414.

The above described ice straws may be formed using a system or method for freezing ice into the shapes and sizes described. For example, one or more molds may be filled with liquid (e.g., water) and frozen to form the straw.

Figure 5A:
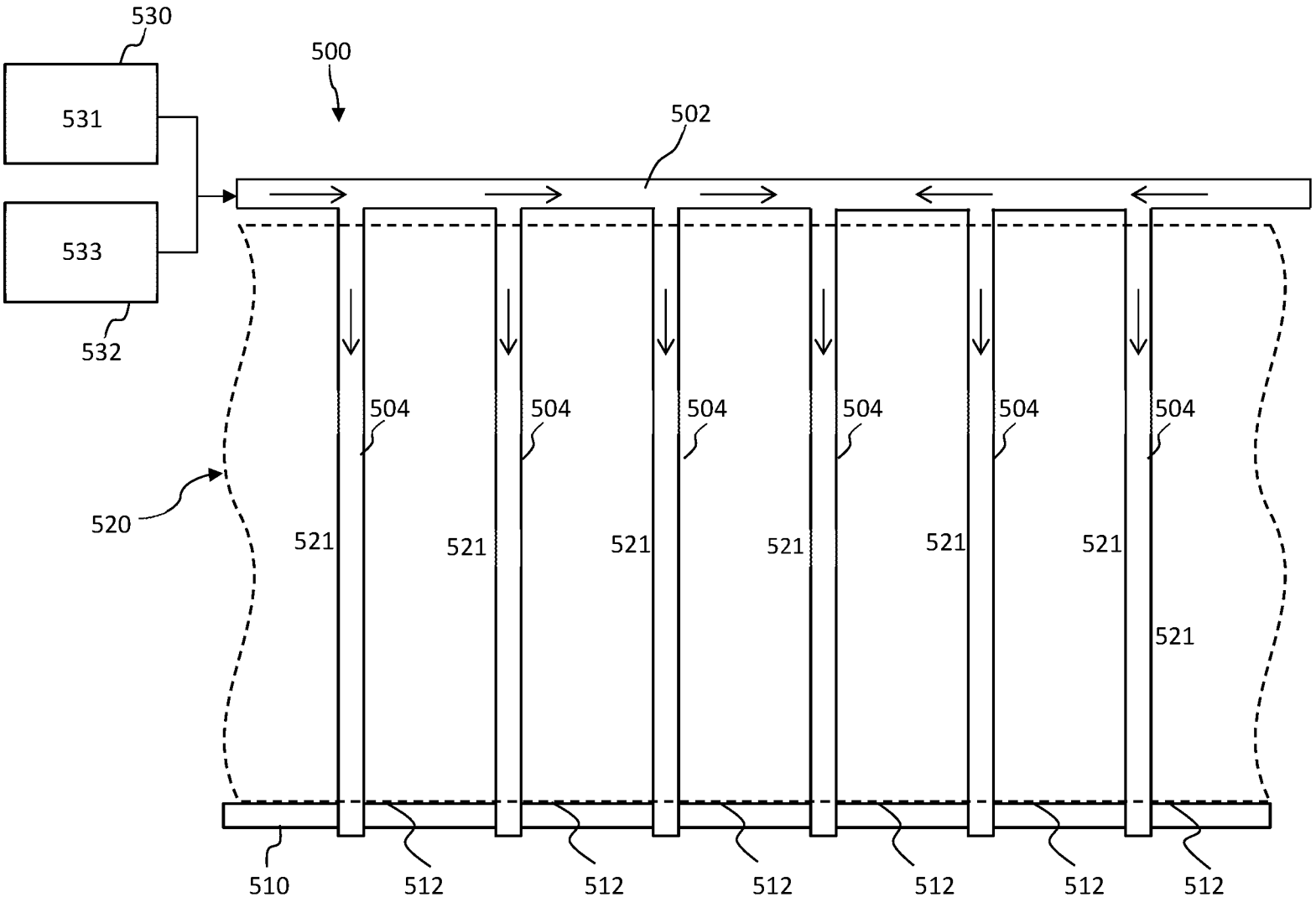
FIG. 5 illustrates a system for degradable drinking straw making according to an embodiment of the disclosure.
Figure 5B:
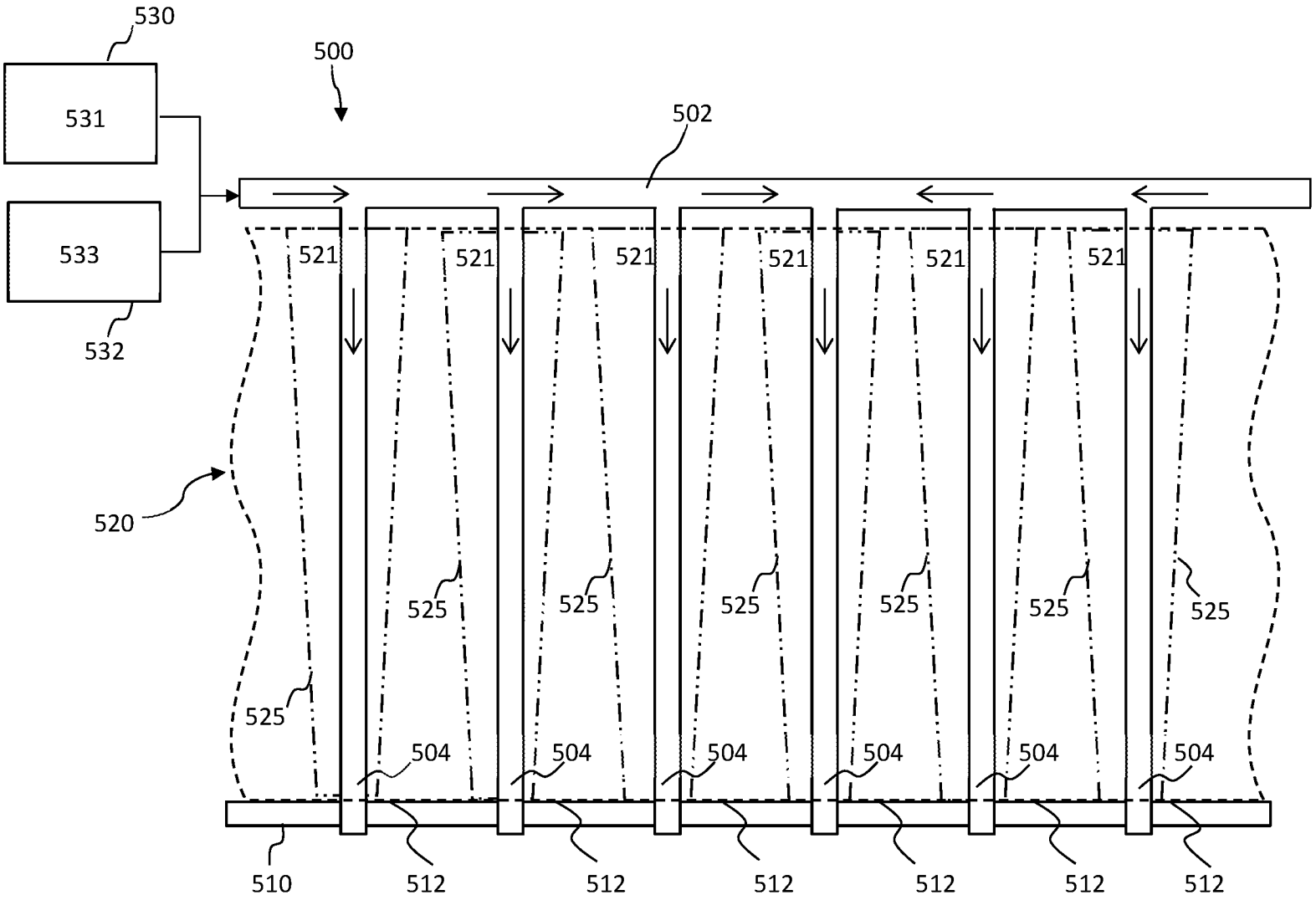

Referring to FIGS. 5A-5B, a system 500 for making one or more straws (which may be similar to any of the straws 100,200, 300, and 400 described above) is shown. The system 500 may comprise one or more (or a plurality of) tubes 504 (which may also be called bars, pipes, and/or cylinders) configured to extend into a reservoir 520 (or tank). The tubes 504 may each be in fluid communication with a connecting bar 502, wherein fluid (e.g., a liquid and/or a gas) within the connecting bar 502 may be directed into the tubes 504. In some embodiments, the system 500 may comprise a source of cold fluid 530 (e.g., a refrigeration device comprising a compressor and a fluid which can be pressurized and depressurized) and a source of hot fluid 532 (e.g., a hot water heater or forced-air heating device) in fluid communication with the connecting bar 502, wherein one source 530 and 532 may be accessed (or activated) at a time to fill the connecting bar 502 and therefore the tubes 504.

In some embodiments, the tubes 504 may be sized and shaped to form an interior hollow of an ice straw (which may be similar to any of the straws 100,200,300, and 400 described above). In some embodiments, the tubes 504 may be tapered from one end to the other. In some embodiments, the taper of the tubes 504 may facilitate removal of the ice that forms around the lubes 504. In some embodiments, the system 500 may comprise a plurality of connecting bars 502 all in fluid communication with the source of cold fluid 530 and the source of hot fluid 532, wherein each connecting bar 502 may be in fluid communication with at least one tube 504. Only a single row of tubes 504 is shown in FIGS. 5A and 5B, but in some embodiments, the connecting bars 502 and lubes 504 may form a grid or other pattern extending within the reservoir 520.

In some embodiments, a bottom portion of the tubes 504 may be inserted into (and/or brought into contact with) a base plate 510, wherein the base plate 510 may comprise a plurality of openings 512 configured to receive the bottom portion of the tubes 504. In some embodiments, the openings 512 and/or the tubes 504 may comprise a sealing material configured to provide a seal between the surface of the tube 504 and the surface of the opening 512. In some embodiments, the bottom portion of the tubes 504 may extend through the entire thickness of the base plate 510, while in other embodiments, the bottom portion of the tubes 504 may extend through only a portion of the thickness of the base plate 510 (e.g., one third of the thickness, one fourth of the thickness, one half of the thickness, two thirds of the thickness, and/or another fraction of the thickness of the base plate 510). Alternatively, the bottom portion of the tubes 504 may be brought into contact with the base plate 510 without extending into any openings and may only contact a top surface of the base plate 510. In some embodiments, the tubes 504 may seal with the top surface of the base plate 510.

In some embodiments, the tubes 504 and/or the base plate 510 may be configured to move with respect to one another, wherein in a first position (shown in FIGS. 5A and 5B) the base plate 510 may form the base of the reservoir 520, allowing the reservoir 520 to be filled with water (and/or another liquid) (e.g., as shown by the dashed lines in FIGS. 5A and 5B).

Figure 6:
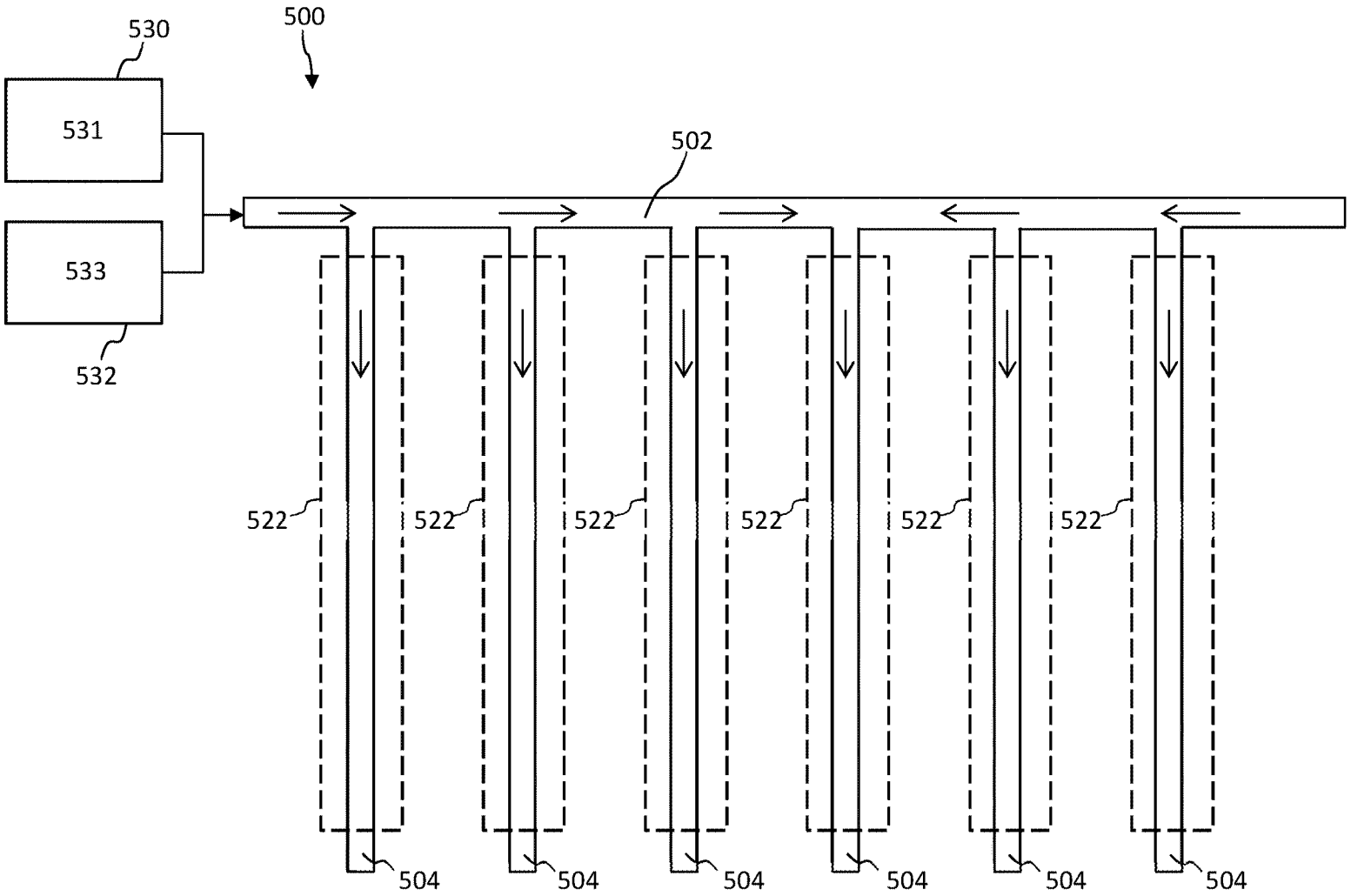
FIG. 6 illustrates the system for degradable drinking straw making shown in FIG. 5 according to an embodiment of the disclosure.

In some embodiments, while the reservoir 520 is filled with a liquid 521, e.g., water, the source of cold fluid 530 may provide a cold fluid, the cold fluid being a first fluid 531 at a temperature at or below the freezing point of the liquid 521, into the connecting bar 502 and therefore into the tubes 504. By lowering the temperature of the tubes 504 to below the freezing temperature of the liquid 521, a phase change from liquid to solid may be caused to form in the liquid 521 along the surface of the tubes 504 forming the degradable drinking straws 522 (as shown in FIG. 6). The shape and size of the tubes 504 may determine the size and shape of the degradable drinking straws (e.g., in the case of liquid 521 being water, the size and shape of the ice) that is formed around the tubes 504. In some embodiments, the ice may form uniformly around a tube 504 which is cylindrically shaped to create a cylindrical shape of ice with a cylindrical hollow through the ice in the shape of the tube 504. In some embodiments, the ice may form uniformly around a tube 504 which is conically shaped to create a conical shape of ice with a conical hollow through the ice in the shape of the tube 504. In some embodiments, as shown in FIG. 5B, the reservoir 520 may be segmented into individual sections 525 (e.g., to form a mold for the degradable drinking straw 522) in which each individual tube 504 may be inserted, the shape of the individual sections of the reservoir 520 may be e.g., conical, cylindrical, irregular, or other shapes. The individual sections of reservoir 520 may provide for the outer appearance of the degradable drinking straws 522. In embodiments, the outer shape of the degradable drinking straw 522 need not mimic the hollow shape (e.g., 214 and 314) of the degradable drinking straw 522, as the hollow shape may be determined by the shape of lube 504 and the outer shape may be determined by the shape of reservoir 520. Ice may be allowed to form around the tubes 504 for a predetermined amount of time, wherein the time may be used to control the thickness of the ice that is formed around the tubes 504. In some embodiments, the tubes 504 may be spaced sufficiently apart to allow ice to form around each of the tubes 504 without the ice forming on one tube 504 contacting or interfering with the ice forming on an adjacent tube 504.

Referring to FIG. 6, after ice (or other liquid which has been frozen) and has formed around the tubes 504 in the shape of degradable drinking straws 522, the reservoir 520 (shown in FIG. 5) may be emptied, exposing the ice (e.g., degradable drinking straws). In some embodiments, the base plate 510 may be moved out of contact with the tubes 504. In some embodiments, the base plate 510 may comprise a material configured to prevent ice forming or sticking to the base plate 510. In some embodiments the base plate 510 will articulate upon completion of the degradable drinking straws 522 formation process and allow for the degradable drinking straws 522 to slide into individual receptacles below the tubes 504. In some embodiments the base plate 510 will articulate upon completion of the degradable drinking straws 522 formation process and allow for the degradable drinking straws 522 to disassociate from the tubes 504. In some embodiments the base plate 510 will articulate upon completion of the degradable drinking straws 522 formation process and allow for the degradable drinking straws 522 to disassociate from the tubes 504 and, upon dissociation, enter into individual receptacles below the tubes 504 once a second fluid is introduced into the connecting bar 502 and has flowed into contact with the tubes 504. In some embodiments, the base plate 510 comprises partitions below each tube 504 to guide the degradable drinking straws 522 into their proper receptacles upon release. In some embodiments, the receptacles of the degradable drinking straws 522 are configured to dispense the degradable drinking straws 522. In an embodiment, the receptacles move, e.g., rotate, upon request for a degradable drinking straw 522 and pass over an opening which allows for the degradable drinking straw 522 to be dispensed into a waiting glass or other container.

To remove the degradable drinking straws 522 from the tubes 504, the source of hot fluid 532 may provide a hot fluid, the hot fluid being a second fluid 533 at a temperature at or above the melting point of the degradable drinking straws 522, into the connecting bar 502 and therefore into the tubes 504. The second fluid 533 being hot enough to at least partially melt the interface between the degradable drinking straws 522 and the tube 504, without completely melting the degradable drinking straws 522 and/or affecting the integrity of the degradable drinking straws 522. The second fluid 533 may warm the surface of the tube 504 that is contacting the degradable drinking straws 522 enough to "release" the degradable drinking straws 522 from connection with the tubes 504. In some embodiments, the base plate 510 may also be configured to be heated to release any drinking straw 522 that has formed or stuck to the base plate 510.

In some embodiments, the second fluid 533 may be fed into the tubes 504 after the base plate 510 has been removed from contact with the tubes. In other embodiments, the second fluid 533 may be fed into the tubes 504 before the base plate 510 has been removed, and then the ice degradable drinking straws 522 may rest on the base plate 510 as it is moved away from the tubes 504. In some embodiments, the base plate 510 may be moved or positioned at an angle (relative to the tubes 504) to allow the degradable drinking straws 522 to fall in a particular direction, for example, into a holding or storage bin.

Figure 7A:
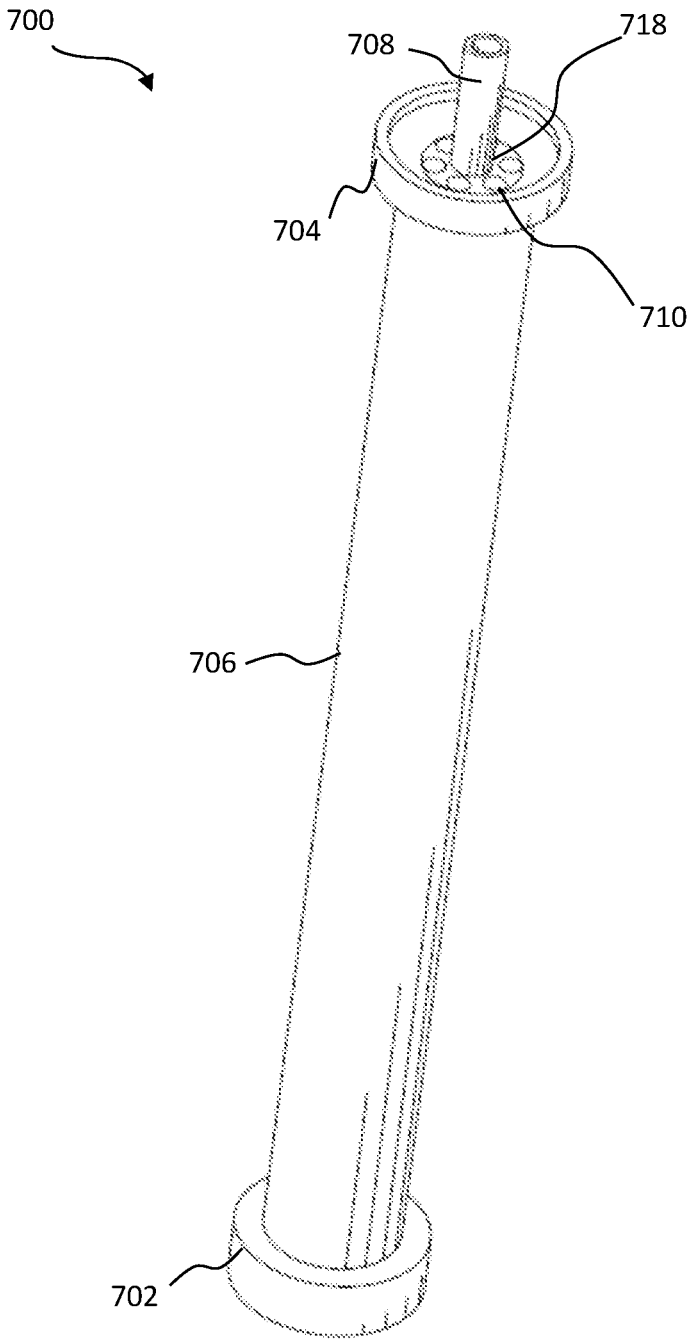
FIGS. 7A-7B illustrate a mold for forming a degradable drinking straw according to an embodiment of the disclosure.
Figure 7B:
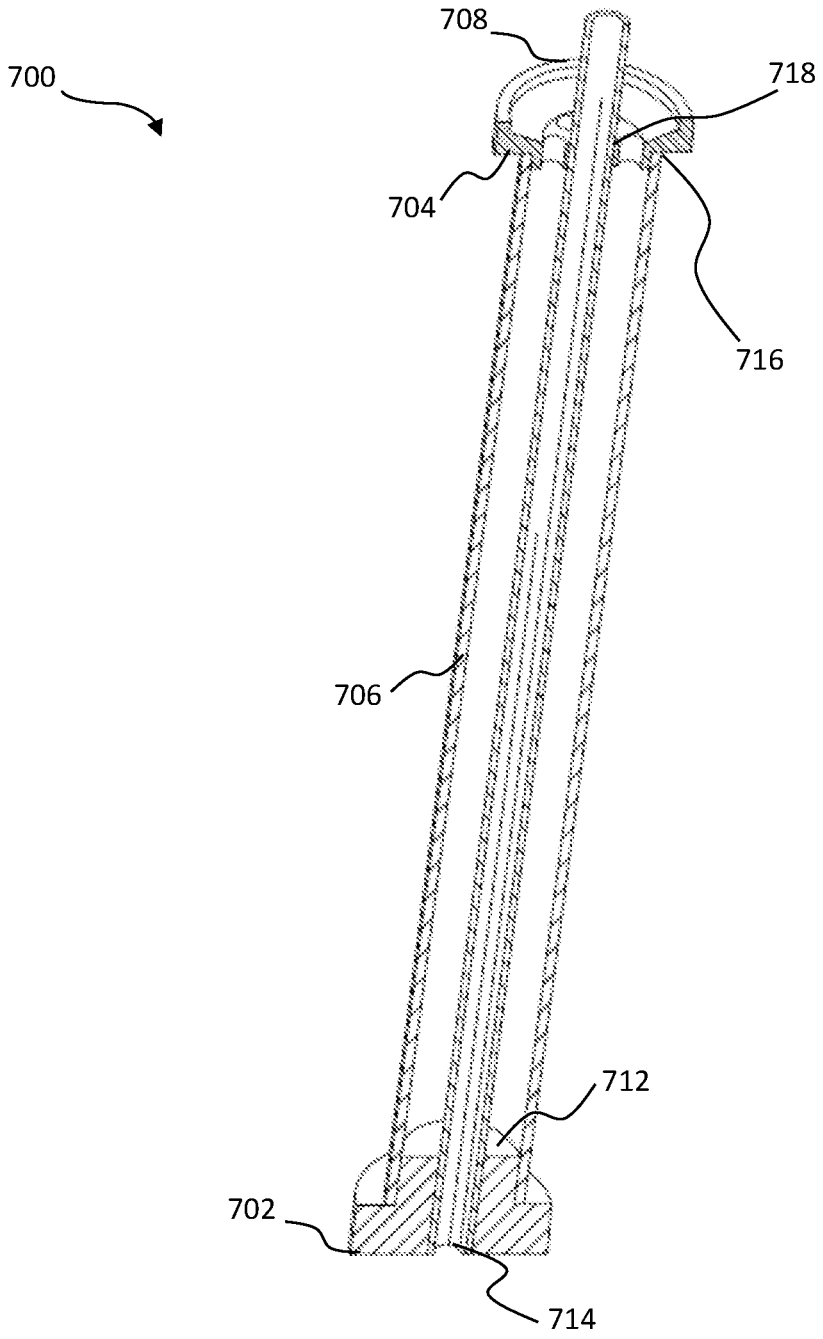

Referring to FIGS. 7A-7B, a mold 700 for making a degradable drinking straw (which may be similar to any of the straws 100,200,300, and 400 described above) is shown. The mold 700 may comprise a base portion 702, a top portion 704, a first tube 706, and a second tube 708.

In some embodiments, the base portion 702 may comprise a flexible material such as silicon, latex, polyurethane, or combinations thereof. In some embodiments, the base portion 702 may comprise at least two tube engagement structures, e.g., a first engagement structure 712 and a second engagement structure 714, wherein the first engagement structure 712 and a the second engagement structure 714 are configured to form leakproof seals between the base portion 702 and the first tube 706 and the second tube 708 upon engagement of the base portion 702 with the first engagement structure 712 and a the second engagement structure 714.

In some embodiments, the top portion 704 may comprise a rigid material such as stainless steel, high-density polyethylene, polycarbonate, styrene acrylonitrile resin, melamine, copolyester, or combinations thereof. In some embodiments, the top portion 704 comprises at least one opening configured for fluid communication 710. In some embodiments, the opening configured for fluid communication 710 is a hole which allows fluid, e.g., water or another liquid, to be introduced into the mold 700. In some embodiments, the opening configured for fluid communication 710 is a hole which allows fluid, e.g., water or another liquid, to be expelled from the mold 700 upon the expansion of a freezing liquid contained in the mold to prevent overstressing the mold 700. In some embodiments, the top portion 704 may comprise a tube engagement structure 716. The lube engagement structure 716 is configured to secure the top portion 702 to the first tube 706 and provide for structural integrity of the mold 700 during the degradable drinking straw production process. In some embodiments, the tube engagement structure 716 comprises a screw closure which is configured to engage threads located on the top end of the first tube 706. In some embodiments, the tube engagement structure 716 comprises an alignment channel configured to engage the top end of the first tube 706 to secure the top portion 704 to the first tube 706. In some embodiments, the top portion 704 comprises a tube opening 718, wherein the tube opening is configured to allow the second tube 708 to pass through the top portion 704.

In some embodiments, the first tube 706 may comprise a rigid material such as stainless steel, high-density polyethylene, polycarbonate, styrene acrylonitrile resin, melamine, copolyester, or combinations thereof. In some embodiments, the first tube 706 comprises a material which conducts heat. The first tube's 706 ability to conduct heat facilitates both the process of freezing of the liquid contained in the mold 700 and the removal of the frozen structure, e.g., a degradable drinking straw (which may be similar to any of the straws 100,200,300, and 400 described above), during the removal process. In some embodiments, the first tube 706 is configured to engage the first engagement structure 712 of the base portion 702 and also engage the top portion 704 via the lube engagement structure 716. In some embodiments, the first tube 706 may comprise threads located at its top end to engage the top portion 704's tube engagement structure 716. In some embodiments, the first tube 706 is configured to accept the second tube 708 and, upon acceptance, form a void between the inner wall portion of the first tube 706 and the outer wall portion of the second tube 708, wherein the void is the portion of the mold 700 which is configured to contain the liquid to be frozen and turned into a degradable drinking straw (which may be similar to any of the straws 100,200, 300, and 400 described above).

In some embodiments, the second tube 708 may comprise a rigid material such as stainless steel, high-density polyethylene, polycarbonate, styrene acrylonitrile resin, melamine, copolyester, or combinations thereof. In some embodiments, the second tube 708 comprises a material which conducts heat. The second tube's 708 ability to conduct heat facilitates both the process of freezing of the liquid contained in the mold 700 and the removal of the frozen structure, e.g., a degradable drinking straw (which may be similar to any of the straws 100,200, 300, and 400 described above), during the removal process. In some embodiments, the second tube 708 is configured to engage the second engagement structure 714 of the base portion 702 and to also pass through the lop portion 704 via the tube opening 718. In some embodiments, the second tube 708 is configured to reside substantially within the first tube 706 and, when in place, form a void between the inner wall portion of the first tube 706 and the outer wall portion of the second tube 708, wherein the void is the portion of the mold 700 which is configured to contain the liquid to be frozen and turned into a degradable drinking straw (which may be similar to any of the straws 100, 200, 300, and 400 described above). In some embodiments, the second tube 708 is configured, via the portion of the second tube 708 which extends beyond the top portion 704 when the second tube 708 has engaged the second engagement structure 714 of the base portion 702 and is residing substantially within the first tube 706, to allow a user to engage the portion of the second tube 708 which extends beyond the top portion 704 to manipulate the mold 700. A user may desire to manipulate the mold to facilitate transport of the mold 700 and/or removal of a degradable drinking straw from the mold 700.

In some embodiments, a method of forming a degradable drinking straw (which may be similar to any of the straws 100, 200, 300, and 400 described above) may comprise introducing a liquid into mold, subjecting the mold and its contained liquid to a temperature at or below the freezing point of the liquid, maintaining the mold and its contained liquid at the temperature at or below the freezing point of the liquid until the liquid within the mold has frozen and formed a frozen structure comprising an outer surface which defines an inner void, wherein the inner void is configured to provide a fluid conduit which spans at least a portion of the length of the frozen structure, subjecting the mold and its contained frozen structure to a temperature at or above the melting point of the frozen structure, maintaining the mold and its contained structure at the temperature at or above the melting point of the frozen structure until the frozen structure can be removed from the mold as the degradable drinking straw, and removing the frozen structure from the mold.

In some embodiments, a method of forming a degradable drinking straw (which may be similar to any of the straws 100, 200, 300, and 400 described above) may comprise introducing a liquid into mold, e.g., mold 700. Introducing liquid into mold 700 may comprise the liquid passing through the at least one opening configured for fluid communication 710 and/or being directly entered into the first tube 706 by way of removing top portion 704.

In some embodiments, subjecting the liquid in contained in the mold 700 to a temperature at or below the freezing point of the liquid may comprise placing the mold 700 and its contained liquid into a compartment of a refrigeration unit, wherein the a temperature of the compartment is at or below the freezing point of the liquid.

In some embodiments, maintaining the mold 700 and its contained liquid at the temperature at or below the freezing point of the liquid until the liquid within the mold has frozen and formed a frozen structure comprising an outer surface which defines an inner void comprises leaving, for a designated time duration, the mold 700 and its contained liquid into a compartment of a refrigeration unit, wherein the a temperature of the compartment is at or below the freezing point of the liquid.

In some embodiments, subjecting the mold 700 and its contained frozen structure to a temperature at or above the melting point of the frozen structure comprises removing the mold 700 and its contained frozen structure from the compartment of the refrigeration unit and placing the mold 700 and its contained frozen structure in a room temperature environment. In some embodiments, subjecting the mold 700 and its contained frozen structure to a temperature at or above the melting point of the frozen structure comprises removing the mold 700 and its contained frozen structure from the compartment of the refrigeration unit and placing the mold 700 and its contained frozen structure in a warm water bath.

In some embodiments, maintaining the mold 700 and its contained frozen structure at a temperature at or above the melting point of the frozen structure comprises leaving, for a designated time duration, the mold 700 and its contained frozen structure in a room temperature environment. In some embodiments, maintaining the mold 700 and its contained frozen structure at a temperature at or above the melting point of the frozen structure comprises leaving, for a designated time duration, the mold 700 and its contained frozen structure in a warm water bath.

In some embodiments, removing the frozen structure from the mold comprises disassembling the mold 700.

In some embodiments, a method of forming a degradable drinking straw (which may be similar to any of the straws 100,200,300, and 400 described above) may comprise assembling the mold 700. In some embodiments, assembling the mold 700 comprises (1) engaging the base portion 702 with the first tube 706 via the first engagement structure 712 of the base portion 702; (2) introducing the second tube 708 into the interior of the first tube 706; (3) engaging the base portion 702 with the second tube 708 via the second engagement structure 714 of the base portion 702; (4) placing the second tube 708 through the tube opening 718 of the top portion 704; and (5) securing the top portion 704 to the first tube 706 via the tube engagement structure 716.

In some embodiments, a method of forming a degradable drinking straw (which may be similar to any of the straws 100, 200, 300, and 400 described above) may comprise removing a frozen structure (i.e., once removed the frozen structure comprises the degradable drinking straw) from the mold 700. In some embodiments, removing the frozen structure from the mold 700 comprises disassembling the mold 700. In some embodiments, disassembling the mold 700 comprises: (1) removing the top portion 704 from its engagement with the first tube 706 via manipulation of the tube engagement structure 716; (2) disassociating the top portion 704 from the second tube 706 via removal of the second tube 708 from the tube opening 718; (3) disengaging the second tube 708 from the second engagement structure 714 of the base portion 702; and (4) removing the second tube 708 from the interior of the first tube 706. In some embodiments, removing the second tube 708 from the interior of the first tube 706 facilitates recovery of the degradable drinking straw via reducing any air pressure forces which may impede removal of the frozen structure from the mold 700.

Having described various devices and methods herein, exemplary embodiments or aspects can include, but are not limited to the following embodiments numbered 1-149:

1. A method of making a degradable drinking straw, comprising: positioning a tube within a reservoir, wherein the reservoir is configured to hold a liquid to be frozen; contacting the tube with a base plate, wherein the tube is at least partially inserted into the base plate, and wherein the base plate forms a base of the reservoir; filling the reservoir with liquid; filling the tube with a first fluid at a temperature at or below the freezing point of the liquid, causing at least a portion of the liquid in the reservoir to freeze around the tube, forming the degradable drinking straw; maintaining the fluid in the tube for an amount of time to form a desired thickness of the degradable drinking straw; and filling the tube with a second fluid at a temperature at or above the melting point of the degradable drinking straw, causing the degradable drinking straw to partially melt at the contact points with the surface of the tube, allowing the degradable drinking straw to be released from contact with the lube.

2. The method of embodiment 1, further comprising removing the liquid from the reservoir.

3. The method of embodiment 1, further comprising removing the liquid from the reservoir, prior to filling the tube with a second fluid at a temperature at or above the melting point of the degradable drinking straw.

4. The method of embodiment 1, further comprising removing the base plate from contact with the tube.

5. The method of embodiment 1, further comprising removing the base plate from contact with the tube, prior to filling the tube with a second fluid at a temperature at or above the melting point of the degradable drinking straw.

6. The method of embodiment 2, further comprising removing the base plate from contact with the tube.

7. The method of embodiment 2, further comprising removing the base plate from contact with the tube, prior to filling the tube with a second fluid at a temperature at or above the melting point of the degradable drinking straw.

8. The method of embodiment 3, further comprising removing the base plate from contact with the tube.

9. The method of embodiment 3, further comprising removing the base plate from contact with the tube, prior to filling the tube with a second fluid at a temperature at or above the melting point of the degradable drinking straw.

10. The method of embodiment 4, wherein the base plate is configured to articulate to allow the degradable drinking straw to disassociate from the tube.

11. The method of embodiment 10, wherein base plate is configured with partitions to guide the degradable drinking straw as it disassociates from the tube and enters a receiving receptacle.

12. The method of embodiment 11, wherein the receiving receptacle of the degradable drinking straw is configured to dispense the degradable drinking straw upon request.

13. The method of embodiment 12, wherein the receiving receptacle is configured to move and to pass over an opening, wherein the receiving receptacle dispenses the degradable drinking straw upon passing over the opening.

14. The method of embodiment 5, wherein the base plate is configured to articulate to allow the degradable drinking straw to disassociate from the tube.

15. The method of embodiment 14, wherein base plate is configured with partitions to guide the degradable drinking straw as it disassociates from the tube and enters a receiving receptacle.

16. The method of embodiment 15, wherein the receiving receptacle of the degradable drinking straw is configured to dispense the degradable drinking straw upon request.

17. The method of embodiment 16, wherein the receiving receptacle is configured to move and to pass over an opening, wherein the receiving receptacle dispenses the degradable drinking straw upon passing over the opening.

18. The method of embodiment 6, wherein the base plate is configured to articulate to allow the degradable drinking straw to disassociate from the tube.

19. The method of embodiment 18, wherein base plate is configured with partitions to guide the degradable drinking straw as it disassociates from the tube and enters a receiving receptacle.

20. The method of embodiment 19, wherein the receiving receptacle of the degradable drinking straw is configured to dispense the degradable drinking straw upon request.

21. The method of embodiment 20, wherein the receiving receptacle is configured to move and to pass over an opening, wherein the receiving receptacle dispenses the degradable drinking straw upon passing over the opening.

22. The method of embodiment 7, wherein the base plate is configured to articulate to allow the degradable drinking straw to disassociate from the tube.

23. The method of embodiment 22, wherein base plate is configured with partitions to guide the degradable drinking straw as it disassociates from the tube and enters a receiving receptacle.

24. The method of embodiment 23, wherein the receiving receptacle of the degradable drinking straw is configured to dispense the degradable drinking straw upon request.

25. The method of embodiment 24, wherein the receiving receptacle is configured to move and to pass over an opening, wherein the receiving receptacle dispenses the degradable drinking straw upon passing over the opening.

26. The method of embodiment 8, wherein the base plate is configured to articulate to allow the degradable drinking straw to disassociate from the tube.

27. The method of embodiment 26, wherein base plate is configured with partitions to guide the degradable drinking straw as it disassociates from the tube and enters a receiving receptacle.

28. The method of embodiment 27, wherein the receiving receptacle of the degradable drinking straw is configured to dispense the degradable drinking straw upon request.

29. The method of embodiment 28, wherein the receiving receptacle is configured to move and to pass over an opening, wherein the receiving receptacle dispenses the degradable drinking straw upon passing over the opening.

30. The method of embodiment 9, wherein the base plate is configured to articulate to allow the degradable drinking straw to disassociate from the tube.

31. The method of embodiment 30, wherein base plate is configured with partitions to guide the degradable drinking straw as it disassociates from the tube and enters a receiving receptacle.

32. The method of embodiment 31, wherein the receiving receptacle of the degradable drinking straw is configured to dispense the degradable drinking straw upon request.

33. The method of embodiment 32, wherein the receiving receptacle is configured to move and to pass over an opening, wherein the receiving receptacle dispenses the degradable drinking straw upon passing over the opening.

34. A method of making a plurality of degradable drinking straws, comprising:

positioning a plurality of tubes within a reservoir, wherein the reservoir is configured to hold a liquid to be frozen; contacting the plurality of tubes with a base plate, wherein the plurality of tubes is at least partially inserted into the base plate, and wherein the base plate forms a base of the reservoir, filling the reservoir with liquid; filling the plurality of tubes with a first fluid at a temperature at or below the freezing point of the liquid, causing at least a portion of the liquid in the reservoir to freeze around the plurality of tubes, forming the plurality of degradable drinking straws; maintaining the fluid in the plurality of tubes for an amount of time to form a desired thickness of each of the plurality of degradable drinking straws; and filling the plurality of tubes with a second fluid at a temperature at or above the melting point of the plurality of degradable drinking straws, causing the plurality of degradable drinking straws to partially melt at the contact points with the surfaces of the plurality of tubes, allowing the plurality of degradable drinking straws to be released from contact with the plurality of tubes.

35. The method of embodiment 34, further comprising removing the liquid from the reservoir.

36. The method of embodiment 34, further comprising removing the liquid from the reservoir, prior to filling the plurality of lubes with a second fluid at a temperature at or above the melting point of the plurality of degradable drinking straws.

37. The method of embodiment 34, further comprising removing the base plate from contact with plurality of tubes.

38. The method of embodiment 34, further comprising removing the base plate from contact with the plurality of tubes, prior to filling the plurality of tubes with a second fluid at a temperature at or above the melting point of the plurality of degradable drinking straws.

39. The method of embodiment 35, further comprising removing the base plate from contact with the plurality of tubes.

40. The method of embodiment 35, further comprising removing the base plate from contact with the plurality of tubes, prior to filling the plurality of tubes with a second fluid at a temperature at or above the melting point of the plurality of degradable drinking straws.

41. The method of embodiment 36, further comprising removing the base plate from contact with the plurality of tubes.

42. The method of embodiment 36, further comprising removing the base plate from contact with the plurality of tubes, prior to filling the plurality of tubes with a second fluid at a temperature at or above the melting point of the plurality of degradable drinking straws.

43. The method of embodiment 37, wherein the base plate is configured to articulate to allow the plurality of degradable drinking straws to disassociate from the plurality of tubes.

44. The method of embodiment 43, wherein base plate is configured with partitions to guide the plurality of degradable drinking straws as they disassociate from the plurality of lubes and enter a plurality of receiving receptacles.

45. The method of embodiment 44, wherein the plurality of receiving receptacles of the plurality of degradable drinking straws are configured to dispense the plurality of degradable drinking straws upon request.

46. The method of embodiment 45, wherein the plurality of receiving receptacles are configured to move and to pass over an opening, wherein each of the plurality of the receiving receptacles dispenses one of the degradable drinking straws upon passing over the opening.

47. The method of embodiment 38, wherein the base plate is configured to articulate to allow the plurality of degradable drinking straws to disassociate from the plurality of tubes.

48. The method of embodiment 47, wherein base plate is configured with partitions to guide the plurality of degradable drinking straws as they disassociate from the plurality of tubes and enter a plurality of receiving receptacles.

49. The method of embodiment 48, wherein the plurality of receiving receptacles of the plurality of degradable drinking straws are configured to dispense the plurality of degradable drinking straws upon request.

50. The method of embodiment 49, wherein the plurality of receiving receptacles are configured to move and to pass over an opening, wherein each of the plurality of the receiving receptacles dispenses one of the degradable drinking straws upon passing over the opening.

51. The method of embodiment 39, wherein the base plate is configured to articulate to allow the plurality of degradable drinking straws to disassociate from the plurality of tubes.

52. The method of embodiment 51, wherein base plate is configured with partitions to guide the plurality of degradable drinking straws as they disassociate from the plurality of tubes and enter a plurality of receiving receptacles.

53. The method of embodiment 52, wherein the plurality of receiving receptacles of the plurality of degradable drinking straws are configured to dispense the plurality of degradable drinking straws upon request.

54. The method of embodiment 53, wherein the plurality of receiving receptacles are configured to move and to pass over an opening, wherein each of the plurality of the receiving receptacles dispenses one of the degradable drinking straws upon passing over the opening.

55. The method of embodiment 40, wherein the base plate is configured to articulate to allow the plurality of degradable drinking straws to disassociate from the plurality of tubes.

56. The method of embodiment 55, wherein base plate is configured with partitions to guide the plurality of degradable drinking straws as they disassociate from the plurality of tubes and enter a plurality of receiving receptacles.

57. The method of embodiment 56, wherein the plurality of receiving receptacles of the plurality of degradable drinking straws are configured to dispense the plurality of degradable drinking straws upon request.

58. The method of embodiment 57, wherein the plurality of receiving receptacles are configured to move and to pass over an opening, wherein each of the plurality of the receiving receptacles dispenses one of the degradable drinking straws upon passing over the opening.

59. The method of embodiment 41, wherein the base plate is configured to articulate to allow the plurality of degradable drinking straws to disassociate from the plurality of tubes.

60. The method of embodiment 59, wherein base plate is configured with partitions to guide the plurality of degradable drinking straws as they disassociate from the plurality of tubes and enter a plurality of receiving receptacles.

61. The method of embodiment 60, wherein the plurality of receiving receptacles of the plurality of degradable drinking straws are configured to dispense the plurality of degradable drinking straws upon request.

62. The method of embodiment 61, wherein the plurality of receiving receptacles are configured to move and to pass over an opening, wherein each of the plurality of the receiving receptacles dispenses one of the degradable drinking straws upon passing over the opening.

63. The method of embodiment 42, wherein the base plate is configured to articulate to allow the plurality of degradable drinking straws to disassociate from the plurality of tubes.

64. The method of embodiment 63, wherein base plate is configured with partitions to guide the plurality of degradable drinking straws as they disassociate from the plurality of tubes and enter a plurality of receiving receptacles.

65. The method of embodiment 64, wherein the plurality of receiving receptacles of the plurality of degradable drinking straws are configured to dispense the plurality of degradable drinking straws upon request.

66. The method of embodiment 65, wherein the plurality of receiving receptacles are configured to move and to pass over an opening, wherein each of the plurality of the receiving receptacles dispenses one of the degradable drinking straws upon passing over the opening.

67. A system for making one or more degradable drinking straws, the system comprising: a base plate configured to form one side of a reservoir for holding a liquid to be frozen into the one or more degradable drinking straws; one or more tubes configured to contact the base plate and positioned within the reservoir; at least one connecting bar in fluid communication with the interior of the one or more tubes; at least one source of a first fluid, the first fluid at a temperature at or below the freezing point of the liquid to be frozen into the one or more degradable drinking straws, in fluid communication with the at least one connecting bar configured to feed the first fluid into the at least one connecting bar and therefore into the one or more tubes; and at least one source of a second fluid, at a temperature at or above the melting point of the one or more degradable drinking straws, in fluid communication with the at least one connecting bar configured to feed the second fluid into the at least one connecting bar and therefore into the one or more tubes.

68. The system of embodiment 67, wherein the one or more tubes are configured to produce the one or more degradable drinking straws having a cylindrical shape.

69. The system of embodiment 67, wherein the one or more tubes are configured to produce the one or more degradable drinking straws having a conical shape.

70. The system of embodiment 67, wherein the one or more tubes are configured to produce the one or more degradable drinking straws having an irregular shape.

71. The system of embodiment 67, wherein the one or more tubes each occupy an individual, segmented section of the reservoir.

72. The system of embodiment 68, wherein the one or more tubes each occupy an individual, segmented section of the reservoir.

73. The system of embodiment 69, wherein the one or more tubes each occupy an individual, segmented section of the reservoir.

74. The system of embodiment 70, wherein the one or more tubes each occupy an individual, segmented section of the reservoir.

75. The system of embodiment 71, wherein the individual, segmented section of the reservoir is configured to form a cylindrically shape degradable drinking straw.

76. The system of embodiment 71, wherein the individual, segmented section of the reservoir is configured to form a conically shaped degradable drinking straw.

77. The system of embodiment 71, wherein the individual, segmented section of the reservoir is configured to form an irregularly shaped degradable drinking straw.

78. The system of embodiment 72, wherein the individual, segmented section of the reservoir is configured to form a cylindrically shaped degradable drinking straw.

79. The system of embodiment 72, wherein the individual, segmented section of the reservoir is configured to form a conically shaped degradable drinking straw.

80. The system of embodiment 72, wherein the individual, segmented section of the reservoir is configured to form an irregularly shaped degradable drinking straw.

81. The system of embodiment 73, wherein the individual, segmented section of the reservoir is configured to form a cylindrically shape degradable drinking straw.

82. The system of embodiment 73, wherein the individual, segmented section of the reservoir is configured to form a conically shaped degradable drinking straw.

83. The system of embodiment 73, wherein the individual, segmented section of the reservoir is configured to form an irregularly shaped degradable drinking straw.

84. The system of embodiment 74, wherein the individual, segmented section of the reservoir is configured to form a cylindrically shape degradable drinking straw.

85. The system of embodiment 74, wherein the individual, segmented section of the reservoir is configured to form a conically shaped degradable drinking straw.

86. The system of embodiment 74, wherein the individual, segmented section of the reservoir is configured to form an irregularly shaped degradable drinking straw.

87. The system of embodiment 67, further comprising at least one receptacle for receiving one of the one or more degradable drinking straws, wherein the base plate is configured with partitions to guide the one of the one or more degradable drinking straws as it disassociates from one of the one or more tubes and enters the at least one receptacle.

88. The system of embodiment 68, further comprising at least one receptacle for receiving one of the one or more degradable drinking straws, wherein the base plate is configured with partitions to guide the one of the one or more degradable drinking straws as it disassociates from one of the one or more tubes and enters the at least one receptacle.

89. The system of embodiment 69, further comprising at least one receptacle for receiving one of the one or more degradable drinking straws, wherein the base plate is configured with partitions to guide the one of the one or more degradable drinking straws as it disassociates from one of the one or more tubes and enters the at least one receptacle.

90. The system of embodiment 70, further comprising at least one receptacle for receiving one of the one or more degradable drinking straws, wherein the base plate is configured with partitions to guide the one of the one or more degradable drinking straws as it disassociates from one of the one or more tubes and enters the at least one receptacle.

91. The system of embodiment 71, further comprising at least one receptacle for receiving one of the one or more degradable drinking straws, wherein the base plate is configured with partitions to guide the one of the one or more degradable drinking straws as it disassociates from one of the one or more tubes and enters the at least one receptacle.

92. The system of embodiment 72, further comprising at least one receptacle for receiving one of the one or more degradable drinking straws, wherein the base plate is configured with partitions to guide the one of the one or more degradable drinking straws as it disassociates from one of the one or more tubes and enters the at least one receptacle.

93. The system of embodiment 73, further comprising at least one receptacle for receiving one of the one or more degradable drinking straws, wherein the base plate is configured with partitions to guide the one of the one or more degradable drinking straws as it disassociates from one of the one or more tubes and enters the at least one receptacle.

94. The system of embodiment 74, further comprising at least one receptacle for receiving one of the one or more degradable drinking straws, wherein the base plate is configured with partitions to guide the one of the one or more degradable drinking straws as it disassociates from one of the one or more tubes and enters the at least one receptacle.

95. The system of embodiment 75, further comprising at least one receptacle for receiving one of the one or more degradable drinking straws, wherein the base plate is configured with partitions to guide the one of the one or more degradable drinking straws as it disassociates from one of the one or more tubes and enters the at least one receptacle.

96. The system of embodiment 76, further comprising at least one receptacle for receiving one of the one or more degradable drinking straws, wherein the base plate is configured with partitions to guide the one of the one or more degradable drinking straws as it disassociates from one of the one or more lubes and enters the at least one receptacle.

97. The system of embodiment 77, further comprising at least one receptacle for receiving one of the one or more degradable drinking straws, wherein the base plate is configured with partitions to guide the one of the one or more degradable drinking straws as it disassociates from one of the one or more tubes and enters the at least one receptacle.

98. The system of embodiment 78, further comprising at least one receptacle for receiving one of the one or more degradable drinking straws, wherein the base plate is configured with partitions to guide the one of the one or more degradable drinking straws as it disassociates from one of the one or more tubes and enters the at least one receptacle.

99. The system of embodiment 79, further comprising at least one receptacle for receiving one of the one or more degradable drinking straws, wherein the base plate is configured with partitions to guide the one of the one or more degradable drinking straws as it disassociates from one of the one or more tubes and enters the at least one receptacle.

100. The system of embodiment 80, further comprising at least one receptacle for receiving one of the one or more degradable drinking straws, wherein the base plate is configured with partitions to guide the one of the one or more degradable drinking straws as it disassociates from one of the one or more tubes and enters the at least one receptacle.

101. The system of embodiment 81, further comprising at least one receptacle for receiving one of the one or more degradable drinking straws, wherein the base plate is configured with partitions to guide the one of the one or more degradable drinking straws as it disassociates from one of the one or more tubes and enters the at least one receptacle.

102. The system of embodiment 82, further comprising at least one receptacle for receiving one of the one or more degradable drinking straws, wherein the base plate is configured with partitions to guide the one of the one or more degradable drinking straws as it disassociates from one of the one or more lubes and enters the at least one receptacle.

103. The system of embodiment 83, further comprising at least one receptacle for receiving one of the one or more degradable drinking straws, wherein the base plate is configured with partitions to guide the one of the one or more degradable drinking straws as it disassociates from one of the one or more tubes and enters the at least one receptacle.

104. The system of embodiment 84, further comprising at least one receptacle for receiving one of the one or more degradable drinking straws, wherein the base plate is configured with partitions to guide the one of the one or more degradable drinking straws as it disassociates from one of the one or more tubes and enters the at least one receptacle.

105. The system of embodiment 85, further comprising at least one receptacle for receiving one of the one or more degradable drinking straws, wherein the base plate is configured with partitions to guide the one of the one or more degradable drinking straws as it disassociates from one of the one or more tubes and enters the at least one receptacle.

106. The system of embodiment 86, further comprising at least one receptacle for receiving one of the one or more degradable drinking straws, wherein the base plate is configured with partitions to guide the one of the one or more degradable drinking straws as it disassociates from one of the one or more lubes and enters the at least one receptacle.

107. A mold for forming a degradable drinking straw comprising:

a base portion, wherein the base portion comprises at least two tube engagement structures; a top portion, wherein the top portion comprises at least one opening configured for fluid communication, a tube engagement structure, and a tube opening; a first tube, wherein the first tube is configured to engage a first engagement structure of the base portion and also engage the top portion; and a second tube, wherein the second tube is configured to engage a second engagement structure of the base portion, pass through the tube opening of the top portion, and substantially reside within the interior of the first tube.

108. The mold of embodiment 107, wherein the base portion comprises a flexible material.

109. The mold of embodiment 108, wherein the flexible material comprises silicon, latex, polyurethane, or combinations thereof.

110. The mold of embodiment 107, wherein the top portion comprises a screw closure and the first lube comprises a threaded portion, wherein the screw closure engages the threaded portion to secure the top portion to the first lube.

111. The mold of embodiment 107, wherein the top portion comprises an alignment channel configured to engage the first tube to secure the top portion to the first tube.

112. The mold of embodiment 107, wherein the top portion comprises a rigid material.

113. The mold of embodiment 112, wherein the rigid material comprises stainless steel, high-density polyethylene, polycarbonate, styrene acrylonitrile resin, melamine, copolyester, or combinations thereof.

114. The mold of embodiment 107, wherein the at least one opening configured for fluid communication of the top portion is configured to allow for fluid which is to be frozen to be introduced into void defined by an inner surface of the first tube, an outer surface of the second tube, and the first engagement structure of the base portion.

115. The mold of embodiment 107, wherein the at least one opening configured for fluid communication of the top portion is configured to allow for a portion of fluid within the mold to escape upon expansion of the fluid due to freezing.

116. The mold of embodiment 107, wherein the first tube comprises a rigid material.

117. The mold of embodiment 116, wherein the rigid material comprises stainless steel, high-density polyethylene, polycarbonate, styrene acrylonitrile resin, melamine, copolyester, or combinations thereof.

118. The mold of embodiment 107, wherein engagement of the first tube with the first engagement structure of the base portion forms a leakproof seal.

119. The mold of embodiment 107, wherein the second tube comprises a rigid material.

120. The mold of embodiment 119, wherein the rigid material comprises stainless steel, high-density polyethylene, polycarbonate, styrene acrylonitrile resin, melamine, copolyester, or combinations thereof.

121. The mold of embodiment 107, wherein the second tube is configured to allow a user or user device to engage the second tube above the tube opening for manipulation of the mold.

122. The mold of embodiment 107, wherein engagement of the second tube with the second engagement structure of the base portion forms a leakproof seal.

123. The mold of embodiment 107, wherein the first tube is configured to conduct heat.

124. The mold of embodiment 107, wherein the second tube is configured to conduct heat.

125. A method of forming a degradable drinking straw comprising: introducing a liquid into a mold; subjecting the mold and its contained liquid to a temperature at or below the freezing point of the liquid; maintaining the mold and its contained liquid at the temperature at or below the freezing point of the liquid until the liquid within the mold has frozen and formed a frozen structure comprising an outer surface which defines an inner void, wherein the inner void is configured to provide a fluid conduit which spans at least a portion of the length of the frozen structure; subjecting the mold and its contained frozen structure to a temperature at or above the melting point of the frozen structure; maintaining the mold and its contained structure at the temperature at or above the melting point of the frozen structure until the frozen structure can be removed from the mold as the degradable drinking straw; and removing the frozen structure from the mold.

126. The method of embodiment 125, further comprising: removing the frozen structure from the mold via dissembling at least a portion of the mold, wherein the mold comprises: a base portion, wherein the base portion comprises at least two tube engagement structures; a top portion, wherein the top portion comprises at least one opening configured for fluid communication, a tube engagement structure, and a tube opening; a first tube, wherein the first tube is configured to engage a first engagement structure of the base portion and also engage the top portion; and a second tube, wherein the second tube is configured to engage a second engagement structure of the base portion, pass through the tube opening of the top portion, and substantially reside within the interior of the first tube.

127. The method of embodiment 125, wherein subjecting the mold and its contained liquid to a temperature at or below the freezing point of the liquid comprises placing the mold and its contained liquid into a compartment of a refrigeration unit, wherein the a temperature of the compartment is at or below the freezing point of the liquid.

128. The method of embodiment 126, wherein subjecting the mold and its contained liquid to a temperature at or below the freezing point of the liquid comprises placing the mold and its contained liquid into a compartment of a refrigeration unit, wherein the a temperature of the compartment is at or below the freezing point of the liquid.

129. The method of embodiment 126, further comprising assembling the mold.

130. The method of embodiment 129, wherein assembling the mold comprises: engaging the base portion with the first tube via the first engagement structure of the base portion; introducing the second tube into the interior of the first tube; engaging the base portion with the second tube via the second engagement structure of the base portion; placing the second tube through the tube opening of the top portion; and securing the top portion to the first tube via the tube engagement structure.

131. The method of embodiment 126, wherein disassembling at least a portion of the mold comprises: removing the top portion from its engagement with the first tube via manipulation of the tube engagement structure; disassociating the top portion from the second tube via removal of the second tube from the tube opening; disengaging the second tube from the base portion; and removing the second tube from the interior of the first tube.

132. The method of embodiment 131, wherein removing the second tube from the interior of the first tube facilitates recovery of the degradable drinking straw via reducing any air pressure forces which may impede removal of the frozen structure from the mold.

133. A degradable drinking straw comprising: a frozen liquid, wherein the frozen liquid forms a wall which comprises an inner void, wherein the inner void provides a fluid conduit which passes through the frozen liquid.

134. The degradable drinking straw of embodiment 133, wherein the wall comprises an outer diameter and an inner diameter, wherein the inner diameter spans the inner void.

135. The degradable drinking straw of embodiment 134, wherein the degradable drinking straw comprises a length between about 3.0 inches and about 10.0 inches.

136. The degradable drinking straw of embodiment 135, wherein the outer diameter is between about 0.5 inches and 1.5 inches.

137. The degradable drinking straw of embodiment 136, wherein the inner diameter is between about 0.1 inches and 0.5 inches.

138. The degradable drinking straw of embodiment 137, wherein the degradable drinking straw comprises a substantially cylindrical shape.

139. The degradable drinking straw of embodiment 138, wherein the inner diameter is substantially constant from a first end of the wall to a second end of the wall.

140. The degradable drinking straw of embodiment 138, wherein the inner diameter reduces in size from a first end of the wall to a second end of the wall.

141. The degradable drinking straw of embodiment 134, wherein the degradable drinking straw comprises a substantially conical shape.

142. The degradable drinking straw of embodiment 141, wherein the outer diameter reduces in size from a first end of the wall to a second end of the wall.

143. The degradable drinking straw of embodiment 141, wherein the inner diameter is substantially constant from a first end of the wall to a second end of the wall.

144. The degradable drinking straw of embodiment 141, wherein the inner diameter reduces in size from a first end of the wall to a second end of the wall.

145. The degradable drinking straw of embodiment 134, wherein the degradable drinking straw comprises an irregular shape.

146. The degradable drinking straw of embodiment 144, wherein the inner diameter is substantially constant from a first end of the wall to a second end of the wall.

147. The degradable drinking straw of embodiment 144, wherein the inner diameter reduces in size from a first end of the wall to a second end of the wall.

148. The degradable drinking straw of embodiment 133, further comprising a cap, wherein the cap is configured to fit over a top end of the degradable drinking straw to prevent a user's mouth from directly contacting the degradable drinking straw.

149. The degradable drinking straw of embodiment 148, wherein the cap comprises paper, plastic, wax, or combinations thereof.

While various embodiments in accordance with the principles disclosed herein have been shown and described above, modifications thereof may be made by one skilled in the art without departing from the spirit and the teachings of the disclosure. The embodiments described herein are representative only and are not intended to be limiting. Many variations, combinations, and modifications are possible and are within the scope of the disclosure. Alternative embodiments that result from combining, integrating, and/or omitting features of the embodiment(s) are also within the scope of the disclosure. Accordingly, the scope of protection is not limited by the description set out above, but is defined by the claims which follow that scope including all equivalents of the subject matter of the claims. Each and every claim is incorporated as further disclosure into the specification and the claims are embodiment(s) of the present invention(s). Furthermore, any advantages and features described above may relate to specific embodiments, but shall not limit the application of such issued claims to processes and structures accomplishing any or all of the above advantages or having any or all of the above features.

Additionally, the section headings used herein are provided for consistency with the suggestions under 37 C.F.R. 1.77 or to otherwise provide organizational cues. These headings shall not limit or characterize the invention(s) set out in any claims that may issue from this disclosure. Specifically and by way of example, although the headings might refer to a "Field," the claims should not be limited by the language chosen under this heading to describe the so-called field. Further, a description of a technology in the "Background" is not to be construed as an admission that certain technology is prior art to any invention(s) in this disclosure. Neither is the "Summary" to be considered as a limiting characterization of the invention(s) set forth in issued claims. Furthermore, any reference in this disclosure to "invention" in the singular should not be used to argue that there is only a single point of novelty in this disclosure. Multiple inventions may be set forth according to the limitations of the multiple claims issuing from this disclosure, and such claims accordingly define the invention(s), and their equivalents, that are protected thereby. In all instances, the scope of the claims shall be considered on their own merits in light of this disclosure, but should not be constrained by the headings set forth herein.

Use of broader terms such as "comprises," "includes," and "having" should be understood to provide support for narrower terms such as "consisting of," "consisting essentially of," and "comprised substantially of." Use of the terms "optionally," "may," "might," "possibly," and the like with respect to any element of an embodiment means that the element is not required, or alternatively, the element is required, both alternatives being within the scope of the embodiment(s). Also, references to examples are merely provided for illustrative purposes, and are not intended to be exclusive.

While several embodiments have been provided in the present disclosure, it should be understood that the disclosed systems and methods may be embodied in many other specific forms without departing from the spirit or scope of the present disclosure. The present examples are to be considered as illustrative and not restrictive, and the intention is not to be limited to the details given herein. For example, the various elements or components may be combined or integrated in another system or certain features may be omitted or not implemented.

Also, techniques, systems, subsystems, and methods described and illustrated in the various embodiments as discrete or separate may be combined or integrated with other systems, modules, techniques, or methods without departing from the scope of the present disclosure. Other items shown or discussed as directly coupled or communicating with each other may be indirectly coupled or communicating through some interface, device, or intermediate component, whether electrically, mechanically, or otherwise. Other examples of changes, substitutions, and alterations are ascertainable by one skilled in the art and could be made without departing from the spirit and scope disclosed herein.

What is claimed is:

1. A system for making one or more degradable drinking straws, the system comprising:

a base plate configured to form one side of a reservoir for holding a liquid to be frozen into the one or more degradable drinking straws;

one or more tubes configured to contact the base plate and positioned within the reservoir and to contact the liquid to be frozen, wherein a content of the one or more tubes consists of a first fluid and a second fluid;

at least one connecting bar in fluid communication with the interior of the one or more tubes, wherein the at least one connecting bar and the base plate are substantially parallel and separated by the reservoir;

at least one source of the first fluid, the first fluid at a temperature at or below the freezing point of the liquid to be frozen into the one or more degradable drinking straws, in fluid communication with the at least one connecting bar configured to feed the first fluid into the at least one connecting bar and therefore into the one or more tubes; and at least one source of the second fluid, the second fluid at a temperature at or above the melting point of the one or more degradable drinking straws, in fluid communication with the at least one connecting bar configured to feed the second fluid into the at least one connecting bar and therefore into the one or more tubes.

2. The system of claim 1, wherein the one or more tubes are configured to produce the one or more degradable drinking straws having a cylindrical shape.

3. The system of claim 1, wherein the one or more tubes are configured to produce the one or more degradable drinking straws having a conical shape.

4. The system of claim 1, wherein the one or more tubes are configured to produce the one or more degradable drinking straws having a shape which is neither conical nor cylindrical.

5. The system of claim 1, wherein the one or more tubes each occupy an individual, segmented section of the reservoir.

6. The system of claim 5, wherein the individual, segmented section of the reservoir is configured to form a cylindrically shape degradable drinking straw.

7. The system of claim 5, wherein the individual, segmented section of the reservoir is configured to form a conically shaped degradable drinking straw.

8. The system of claim 5, wherein the individual, segmented section of the reservoir is configured to form a degradable drinking straw which is neither conical nor cylindrical.

9. The system of claim 1, further comprising at least one receptacle for receiving one of the one or more degradable drinking straws, wherein the base plate is configured with partitions to guide the one of the one or more degradable drinking straws as the base plate disassociates from one of the one or more tubes and enters the at least one receptacle.

10. The system of claim 5, further comprising at least one receptacle for receiving one of the one or more degradable drinking straws, wherein the base plate is configured with partitions to guide the one of the one or more degradable drinking straws as the base plate disassociates from one of the one or more tubes and enters the at least one receptacle.

* * * * *